US010500698B2

(12) United States Patent
Schuster

(10) Patent No.: US 10,500,698 B2
(45) Date of Patent: Dec. 10, 2019

(54) GRINDING DISC

(71) Applicant: Lukas-Erzett Vereinigte Schlief- und Fraswerkzeugfabriken GmbH & Co. KG, Engelskirchen (DE)

(72) Inventor: Jan Schuster, Cologne (DE)

(73) Assignee: Lukas-Erzett Vereinigte Schlief-und Fraswerkzeugfabriken GmbH & Co KG, Engelskirchen (DE)

( * ) Notice: Subject to any disclaimer, the term of this patent is extended or adjusted under 35 U.S.C. 154(b) by 0 days.

(21) Appl. No.: 15/742,715

(22) PCT Filed: Jun. 29, 2016

(86) PCT No.: PCT/EP2016/065107
§ 371 (c)(1),
(2) Date: Jan. 8, 2018

(87) PCT Pub. No.: WO2017/005569
PCT Pub. Date: Jan. 12, 2017

(65) Prior Publication Data

US 2018/0193981 A1 Jul. 12, 2018

(30) Foreign Application Priority Data

Jul. 9, 2015 (EP) ..... 15176163

(51) Int. Cl.
*B24D 13/06* (2006.01)
*B24D 13/08* (2006.01)
*B24D 9/08* (2006.01)

(52) U.S. Cl.
CPC ..... *B24D 13/06* (2013.01); *B24D 9/08* (2013.01); *B24D 13/08* (2013.01)

(58) Field of Classification Search
CPC ..... B24D 9/08; B24D 13/06; B24D 13/08; B24D 18/0045; B24D 5/066; B24D 5/16; B24D 7/16; B24B 37/22
(Continued)

(56) References Cited

U.S. PATENT DOCUMENTS 1,303,541 A * 5/1919 Curtis ..... B24D 5/12 30/1
2,479,079 A * 8/1949 Reid, Jr. ..... B24D 5/04 451/544

(Continued)

FOREIGN PATENT DOCUMENTS

DE 19511004 C1 9/1996
DE 102008023946 B3 4/2009

(Continued)

OTHER PUBLICATIONS

English machine translation of Brunelle, FR-2621846-A1 (Year: 1989).*

(Continued)

*Primary Examiner* — Monica S Carter
*Assistant Examiner* — Marcel T Dion
(74) *Attorney, Agent, or Firm* — Dinsmore & Shohl LLP

(57) ABSTRACT

Embodiments described herein generally relate to a grinding disc is being rotatably drivable around an axis of rotation. The grinding disc has a front side as well as a rear side facing away from the front side. The grinding disc further includes a multi-layered circular grinding blank packet with a plurality of circular grinding blanks. The grinding blanks are flatly stacked over each other along the axis of rotation and in which each grinding blank includes a central through opening. The central through openings form together a recess of the circular grinding blank packet. Wherein the grinding disc has a backing plate, which is arranged in the (Continued)

recess, and the circular grinding blanks each are fixed individually to the backing plate.

20 Claims, 5 Drawing Sheets

(58) Field of Classification Search
USPC ..... 451/544, 548
See application file for complete search history.

(56) References Cited

U.S. PATENT DOCUMENTS 2,616,229 A * 11/1952 Allison ..... B24D 5/123 451/342
2,616,230 A * 11/1952 Hough ..... B24D 5/123 451/342
2,660,009 A * 11/1953 Goldberg ..... B24D 13/08 15/230.19
2,698,783 A * 1/1955 Jones ..... B24D 13/08 451/510
3,292,311 A * 12/1966 Hensley ..... B24D 5/12 451/541
3,417,420 A 12/1968 Rock
3,597,884 A * 8/1971 Kaarlela ..... B24D 5/12 451/544
4,989,375 A * 2/1991 Henmi ..... B21B 28/04 451/544
5,207,028 A * 5/1993 Timmons ..... B24B 45/006 451/342
5,516,326 A * 5/1996 Virnich ..... B24D 5/16 451/340
5,542,875 A * 8/1996 Ichiguchi ..... B24D 13/14 451/533
5,628,679 A * 5/1997 Shiga ..... B24D 13/08 451/508
6,042,461 A * 3/2000 Pearson ..... B23D 45/006 451/342
6,808,446 B1 * 10/2004 Mosier ..... B24D 13/16 451/466
8,393,941 B2 * 3/2013 Ghinelli ..... B24D 3/001 451/526
2006/0040597 A1 * 2/2006 Piliguian ..... B24B 23/02 451/177
2007/0232212 A1 10/2007 Gissing
2008/0295947 A1 * 12/2008 Bourbeau ..... B24D 9/08 156/73.1
2011/0065369 A1 3/2011 Henn et al.
2012/0071073 A1 3/2012 Farber
2013/0025429 A1 1/2013 Eisenblaetter
2013/0273822 A1 * 10/2013 Daday ..... B24D 11/008 451/548
2014/0038502 A1 * 2/2014 Nakayama ..... B24D 13/08 451/529
2015/0000206 A1 * 1/2015 Klett ..... B24D 3/28 51/298
2016/0279763 A1 * 9/2016 Wendt-Ginsberg .... B24D 3/002

FOREIGN PATENT DOCUMENTS

EP 2433748 A2 3/2012
FR 2621846 A1 * 4/1989 ..... B24D 5/066
JP S48-23590 7/1973
JP S58-4360 1/1983
JP H0683263 11/1994
JP H11-033919 2/1999
WO 2006/023178 A1 3/2006
WO 2006/042352 A1 4/2006

OTHER PUBLICATIONS

Search Report for PCT/EP2016/065107, dated Sep. 21, 2016.
Office Action in corresponding Japanese Application 2018-512250 dated Jul. 26, 2018.

* cited by examiner

GRINDING DISC

CROSS-REFERENCE To RELATED APPLICATION

This application is the U.S. national stage of PCT/EP2016/057489 filed Apr. 6, 2016, which claims priority of German Patent Application 10 2015 105 496.5 filed Apr. 10, 2015 of which is hereby incorporated by reference in its entirety

TECHNICAL FIELD

The present specification generally relates to a grinding disc, and, more specifically, to a grinding disc, with which a workpiece can be machined in an abrasive manner.

BACKGROUND

The grinding disc is rotatably driveable around an axis of rotation and has a front side and a rear side facing away from the front side. The grinding disc is, especially, connectable to a driving machine, to be driven. The grinding disc has a multi-layered circular grinding blanks packet with a plurality of circular grinding blanks, wherein the circular grinding blanks are stacked over each other in a flat manner along the axis of rotation and comprise a central through opening. The central through openings form together a recess of the circular grinding blanks packet.

Such a grinding tool is known from WO97/05991 A1. The described tool comprises a plurality of discs, stacked on top of each other and made from a flexible abrasive material, wherein each disc has a central hub portion. The discs each have in the hub portion a central through opening, with which the discs are threaded onto a mandrel or spindle and are centrally clamped to each other by means of a clamping plate. The through openings of the discs form together a recess for accommodating the mandrel or the spindle. In an annular portion, arranged radially outside of the hub portion, the individual discs are radially notched and form radially extending fingers, which form the grinding portion of the tool. The grinding portion or the part of the tool, active for the machining of a workpiece, is not axially supported or reinforced in direction parallel to the axis of rotation. Rather the tool behaves flexible corresponding to the rigidities and flexibilities of the individual discs. Because of the wear while using such a grinding tool a fanning-out and pulling-out of large pieces of the discs are caused.

DE 10 2011 108 859 A1 describes a tool for the abrasive machining of material surfaces with several discs formed for machining in an abrasive manner and which are driveable around an axis of rotation. The individual discs are stacked partially over each other in an overlapping manner such that a part of respectively one disc is arranged on an above arranged disc passing through a notch. Thus, the discs are arranged interlaced in each other or entwined in each other. These discs, connected to each other in such a manner, can be formed as a grinding lamella packet and can be fixed to a backing plate.

DE 195 11 004 C1 shows a tool with a plate-like backing, which has an attachment face. On the attachment face an annular layer packet is arranged. The annular layer packet consists of a plurality of grinding lamellae, which are arranged annularly in a shingled manner and partially overlapping each other. Because of the shingled arrangement of the grinding lamellae, these are not aligned flatly to a surface of the to be machined workpiece.

Accordingly, there is a need to provide a grinding disc, which ensures an optimized alignment of the active grinding surface to the workpiece and has a long tool life.

SUMMARY

In one embodiment, the grinding disc has a backing plate, which is arranged in the recess, formed by means of the through openings of at least a subset, respectively a plurality of the circular grinding blanks, wherein each individual circular grinding blank is fixed to the backing plate. Thus, the individual circular grinding blanks do not have to be connected among themselves nor to each other. However, it is not excluded that besides the attachment of each individual circular grinding blank to the backing plate also a connection of the circular grinding blanks amongst themselves can be provided. However, it is important that the circular grinding blanks of the circular grinding blanks packet are individually fixed to the backing plate, so that a pulling-out of an individual circular grinding blank from the backing plate does not detach the whole circular grinding blanks packet from the backing plate. The circular grinding blanks packet is arranged between the front side and the rear side of the grinding disc. In particular, a first circular grinding blank arranged at the outside of the circular grinding blanks packet forms the front side. In particular, a last circular grinding blank arranged at the outside of the circular grinding blanks packet forms the rear side of the grinding disc. In particular, the axis of rotation is defined by a longitudinal axis that extends at a right angle to the front side and at a right angle to the rear side of the grinding disc and that extends through the rotational center point of the grinding disc.

According to another embodiment, the recess is formed varyingly at least along a longitudinal portion in the circumference. Especially, the shape and/or size of the recess is defined or delimited by the central through openings of at least a partial number or plurality of the circular grinding blanks. Furthermore, the central through openings can be formed differently large of at least a subset of the circular grinding blanks of the circular grinding blanks packet. In other words, each of the through openings can have in comparison with the other through openings a differently large cross-sectional face. Also, some of the through openings can have the same size or the same large cross-sectional faces, so that only a subset of the through openings has to be formed differently large.

In particular, the recess can be formed such that this is formed increasing in circumference starting from the front side towards the rear side of the circular grinding blanks packet. Thus, the recess is essentially formed conical, wherein the cone opens towards the rear side of the circular grinding blanks packet. Because of the conical recess and the backing plate arranged therein, it is ensured that each circular grinding blank is arranged in direct contact with the backing plate and can be connected thereto. Furthermore, the conical design of the recess ensures that as large as possible face portions of the circular grinding blanks can be connected to the backing plate. Preferably, the central through openings of the circular grinding blanks can at least increase in size along a portion, extending parallel to the axis of rotation, respectively a longitudinal portion, i.e. in direction of the axis of rotation, of the circular grinding blanks packet starting from the front side towards the rear side. Thus, the circular grinding blanks of a first half of the circular grinding blanks packet, which extends for example from the front side up to the center of the grinding disc, can for example have through openings which successively are larger. Alternatively or additionally, the central through openings of the circular grinding blanks can be formed getting larger at least along a portion of the circular grinding blanks packet, extending parallel to the axis of rotation, starting from the rear side towards the front side. Thus, for example the circular grinding blanks of a first or second half of the circular grinding blanks packet, which extends for example from the rear side up to the center of the grinding disc, can have successively increasing through openings. In a combination, the grinding disc can have especially a first half with circular grinding blanks, which through openings increase starting from the front side to the rear side, and a second half with circular grinding blanks, which through openings are getting larger starting from the rear side to the front side or again are getting smaller from the center of the grinding disc towards the rear side.

For forming the recess in shape of a cone it can be provided that the central through openings of the circular grinding blanks are formed getting larger starting from the front side of the circular grinding blanks packet towards the rear side. This means, that the cross-sectional faces of the through openings get larger successively towards the rear side. In circular through openings, thus, the diameters of the individual through openings are getting larger towards the rear side.

The individual circular grinding blanks can respectively be connected with a central annular portion on an attachment face of the backing plate, arranged parallel to the front side, to the same. For this, the backing plate is formed step-like preferably in the longitudinal sectional view in relation to the axis of rotation. The backing plate can have several attachment faces, arranged one behind the other in the direction of the axis of rotation on different diameters around the axis of rotation.

In a preferred embodiment, the backing plate is poured into the recess. For this, a hardenable material, like synthetic resin, epoxy resin, phenolic resin or polyurethane or a different material of a gluing- or mastic system, which holds the individual circular grinding blanks after the hardening together, can be placed into the recess.

Preferably, in the backing plate a threaded element with an internal thread is arranged for attaching the grinding disc on a drive machine. In the embodiment, in which the backing plate is poured into the recess, the threaded element, for example in shape of a threaded nut, can be inserted before the filling of the recess by pouring.

The through openings of the circular grinding blanks can have a cross-section deviating from a circle. For example, the through openings can be formed in the shape of a polygon. However, also other possibilities are conceivable, like for example radially extending recesses or webs. Such a design of the through openings ensures an increased rotational safety of the circular grinding blanks packet in relative to the backing plate.

The outer circumferential faces of the individual circular grinding blanks are preferably identical in shape, size and alignment. For example, the outer circumferential faces can be formed circular so that a circular cylindrical outer face of the grinding disc is achieved around the axis of rotation. Furthermore, the circular grinding blanks respectively can have an outer circumferential face, wherein the outer circumferential faces are arranged, when seen in a cross-section of the grinding disc, respectively under forming an angle between 5° and 85°, especially between 20° and 40°, preferably approximately 30° relative to the axis of rotation. Thus, the outer circumferential faces can be arranged roof-shaped. Furthermore, the outer circumferential faces of the circular grinding blanks are arranged on a common circumferential face. The circumferential face can especially be formed conical or cylindrical. Because of the outer circumferential faces aligned at an angle to the axis of rotation also good abrasive results can be achieved with a grinding disc held inclined to the workpiece.

The individual circular grinding blanks can have, furthermore, radial recesses, wherein the radial recesses of the individual circular grinding blanks are formed identical and are aligned with each other in direction to the axis of rotation. Thus, it is ensured that with a rotatably driven grinding disc, the abrasive result is visible through the recesses for the user. In particular, the grinding disc is rotationally symmetrical to the axis of rotation.

According to yet another embodiment, the grinding disc can have a support layer for the axial support of the circular grinding blanks packet. The support layer is preferably arranged on the rear side, but can also be arranged on the front side. The support layer can be a fiber element, especially from a woven fabric. Preferably, the support layer is manufactured from glass fibers and phenolic resin. Thus, the support layer is more rigid or more unbending in comparison to the circular grinding blanks, i.e. the flexibility of the circular grinding blanks is larger than that of the support layer. In the course of the use of the grinding disc and the, thus connected, increasing wear of the circular grinding blanks, a slow bending-over or flapping-over of the lowest or even lower layers of the circular grinding blanks is possible. This can be prevented by the support layer for the axial support of the circular grinding blanks packet. Especially, a maximal radial distance of an outer circumferential face of the support layer is smaller than a maximal radial distance of an outer circumferential face of the circular grinding blank, arranged directly on the support layer or of all circular grinding blanks. Thus, the grinding disc can radially yield at the outside when putting the grinding disc in an inclined manner on the workpiece, whereby a better grinding result is achieved.

Furthermore, at least a subset of the circular grinding blanks can have respectively on a side facing the front side of the grinding disc a grinding layer. I.e. the circular grinding blanks, especially all circular grinding blanks, have a grinding layer respectively an abrasive grain coating. The grinding layer can extend across the whole side facing the front side of the grinding disc or comprise only a partial portion of this side. As the circular grinding blanks have a grinding layer, the circular grinding blanks can be used up one after the other starting from the front side towards the rear side. As soon as the topmost circular grinding blank is worn or used up, the next below circular grinding blank can be used for grinding without having to stop. In an analogous manner, at least a subset of the circular grinding blanks can have additionally or alternatively to the grinding layer on the front side of the circular grinding blank, a grinding layer or an abrasive grain coating on a side facing the rear side of the grinding disc. When the grinding disc has a support layer, which for example is arranged on the rear side of the grinding disc, the individual circular grinding blanks can also have only an abrasive grain coating on the surfaces facing to the front side. Furthermore, the last or the last and further layers, arranged directly in front of the circular grinding blanks can be inserted and cast in also with the grain side against the other layers. In this case, the user can use the grinding disc on both sides and/or can also reverse it. This can be advantageous, when the layers are different from each other, for example contain different grains. However, also in identical circular grinding blanks it can be advantageous, as the flexibility of the circular grinding blanks is generally distinctly lower in grain direction. Thus, the two grinding coatings of neighboring circular grinding blanks, abutting each other, stabilize each other and the grinding disc becomes more rigid. Especially, the whole circular grinding blank can be grinding-able, i.e. the grinding layer extends parallel to the axis of rotation across the whole transversal extension of the respective circular grinding blank and can, thus, be used starting from the side facing the front side up to the side facing the rear side continuously for grinding.

Especially, the circular grinding blanks consist of grinding means on a substrate. The used substrate can be a woven fabric, a scrim or a flies (also pressed). The whole range of common substrates for grinding means on substrate is possible, also combinations, like, for example, paper-woven fabric or other material combinations known on the market or (weak) vulcanized fibers, which wear during operation, to secure a continuous wear of the substrate. Furthermore, the substrate and/or the circular grinding blanks can be as far as possible tensional isotropic. Thus, the substrate wears or the circular grinding blanks wear as far as possible constant, i.e. in a circular manner. Tensile strengths in warp- and weft direction or also in the diagonals should be as far as possible identical. Examples are, for example, grinding means on substrate or substrates therefore, like they are used in segmented broad bands. Furthermore, it can be provided, that the grinding linen and the grinding means on substrate have relative high tensile strengths.

According to yet a further embodiment of the grinding disc, at least one of the circular grinding blanks can have a plurality of circular grinding blank segments, which abut each other in a butt jointed manner being distributed in circumferential direction. Thus, the offcuts during the manufacture of the individual circular grinding blanks can be optimized. In other words, at least one of the circular grinding blanks is composed of several individual pieces, the circular grinding blanks segments, to a circular grinding blank. The individual circular grinding blank segments do not overlap each other, but abut each other in a butt jointed manner. Especially all of the circular grinding blanks are composed of individual circular grinding blank segments.

BRIEF DESCRIPTION OF THE DRAWINGS

Preferred embodiments are described in detail in the following using the drawings. Herein, it shows.

DETAILED DESCRIPTION

Figure 1:
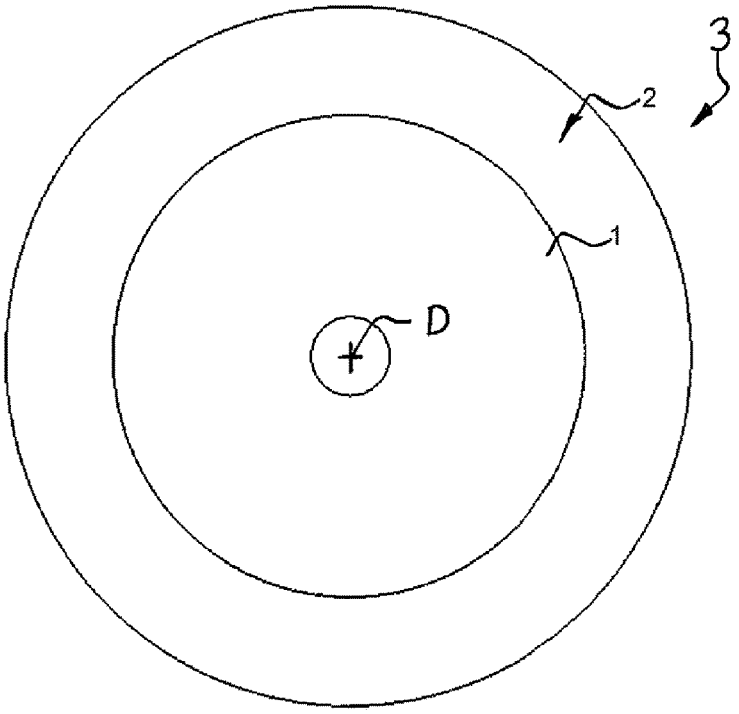
FIG. 1 illustrates a top view onto the rear side of a first embodiment of a grinding disc according to the one or more embodiments shown and described herein.
Figure 2:
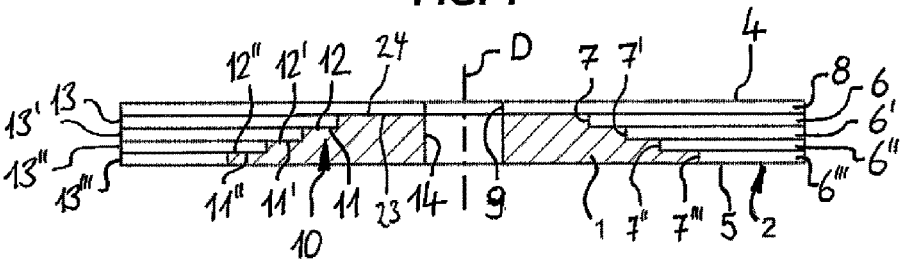
FIG. 2 illustrates a cross-sectional view of the grinding disc of FIG. 1.
Figure 3:
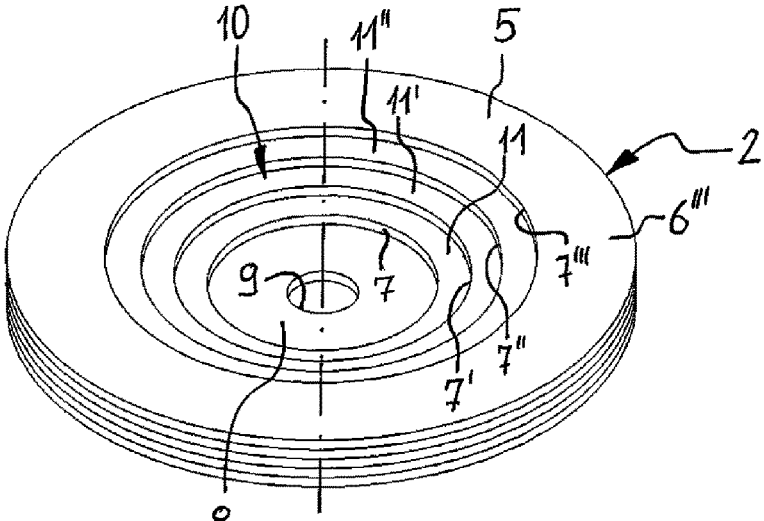
FIG. 3 illustrates a perspective view of the grinding blanks packet of the grinding disc of FIG. 1.

FIGS. 1 to 4 show a first embodiment of a grinding disc 3 and are described in the following together.

The grinding disc 3 comprises a circular grinding blanks packet 2 with a plurality of individual circular grinding blanks 6. The circular grinding blanks packet 2 is fixed to a backing plate 1, wherein each individual circular grinding blank 6 is directly connected or fixed to the backing plate 1. The grinding disc 3 is rotatably drivable around an axis of rotation D. The grinding disc 3 has a front side 4 for the machining of a workpiece. Furthermore, the grinding disc 3 has a rear side 5 facing away from the front side 4. The individual circular grinding blanks 6 are stacked on top of each other in a flat manner in direction of the axis of rotation D. On the front side 4, a final circular blank 8 is provided, which is part of the multi-layered circular grinding blanks packet 2. The final circular blank 8 is also a circular grinding blank of the circular grinding blanks packet 2. The finish circular blank 8 is, however, optional and can also be omitted. All circular grinding blanks 6 have a flexible supporting substrate and are provided at least on the surface, facing the front side 4, with an abrasive grain coating. The final circular blank 8 can also be provided with an abrasive grain coating or be manufactured from the same material as the circular grinding blanks 6. Thus, the final circular blank 8 as a first circular grinding blank, when seen from the front side 4 of the grinding disc 3, can contribute a major part of the grinding efficiency. Generally, the circular grinding blanks 6 and the final circular blank 8 can also be provided on the surface facing the rear side 5 with an abrasive grain coating.

The circular grinding blanks 6 have central through openings 7 and an uninterrupted continuous planar surface. Also the final circular blank 8 is provided with a central through opening 9. The final circular blank 8 can, however, also be provided continuously flat without central through opening.

The central through openings 7 of the circular grinding blanks 6 are formed in the first embodiment of the grinding disc 3 circular concentrically to the axis of rotation D, wherein the diameter of the central through openings 7, starting from the front side 4 towards the rear side 5, are increasing in size. The through openings 7 form, thus, a central recess 10 in the circular grinding blanks packet 2.

Figure 4:
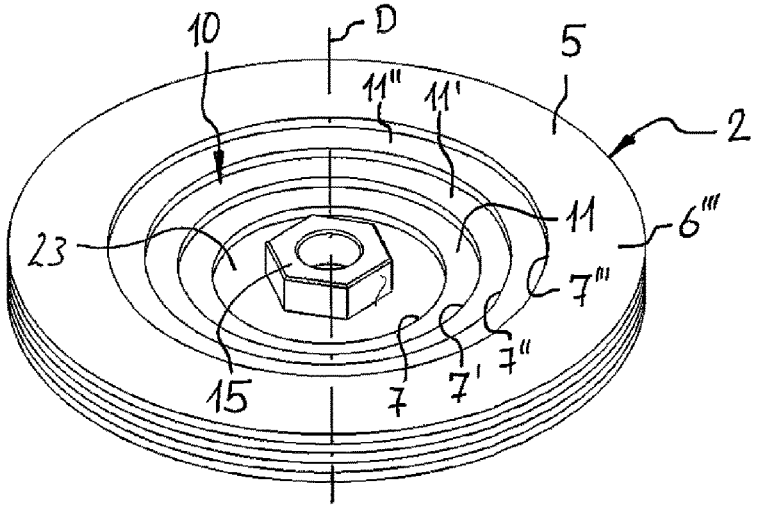
FIG. 4 illustrates a perspective view of the grinding blanks packet of FIG. 3 with a threaded nut inserted in the recess.

In the recess 10 of the circular grinding blanks packet 2, the backing plate 1 is arranged, on which the circular grinding blanks 6 and the final circular blank 8 are attached. In the shown embodiment, the backing plate 1 is poured into the recess 10. In this case, as shown in FIG. 4, beforehand, a threaded nut 15, by means of which the grinding disc 3 is attachable to a driving tool, is inserted in the recess 10. The space around the threaded nut 15 and within the annular discs can then be filled with a hardening material (synthetic resin, epoxy resin, phenolic resin, polyurethane or any other adhering- or mastic system known to the specialist), which bonds together the circular grinding blanks 6 and the threaded nut 15 after the hardening. Alternatively to the threaded nut 15, also other threaded elements or sleeves can be used. A prerequisite is always the attachability on a driving machine. In a preferred case of an angle grinder, the threaded nut 15 has the advantage of the ability to quickly screw it onto the angle grinder. A common hex nut is already sufficient, to improve the stability of the anchoring in the mastic- or resin system. However, also other geometries, especially with increased surface area (roughened, "wings", "rim", etc.) are possible. The material of the threaded element can be metal, preferably stainless metal, however also plastics. Of course also a combination of metal thread, imbedded in a plastic ring, etc. is possible.

In the embodiment of FIGS. 1 to 4 for attaching on a driving machine, the backing plate 1 has a central through opening 14. The recess 10 and the backing plate 1 are, thus, formed essentially conical, wherein the cone angle opens towards the rear side 5.

The diameters of the through openings 7 of the individual circular blanks 6 are, furthermore, stepped such that annular portions 11, laying open facing the rear side 5, are formed, by means of which the individual circular blanks 6 are arranged in abutment to step-like formed attachment faces 12 of the backing plate 1 and are attached thereto. Thus, it is ensured, that an as large as possible face of the individual grinding blanks 6 abuts the backing plate 1. Furthermore, the final circular blank 8 has an annular portion 23, laying open facing towards the rear side 5, by means of which the final circular blank 8 is arranged in abutment to an attachment face 24 of the backing plate 1 and is fixed thereto.

The individual circular grinding blanks 6 have, respectively, a circular outer circumferential face 13. The outer circumferential faces 13 of all circular grinding blanks 6 and of the final circular blank 8 have the same diameter so that as a whole a circular cylindrical outer face of the circular grinding blanks packet 2 is achieved for the grinding disc 3.

The recess 10 is essentially formed like a frustum in a stepped manner, wherein the material, which is for the manufacture of the backing plate 1 poured into the recess 10, does not flow or flows only to a small extent between the circular grinding blanks 6 during the pouring. Ideally, the cone angle of an envelope face enclosing the backing plate 10 is approximately 160 to 170 degress, preferably approximately 164 degress. Thus, it is enabled, that the operator can position the grinding disc 3 in different angles on the surface of the to be machined workpiece. In this case, the circular grinding blanks packet 2 can be completely used up as far as possible till the backing plate 1 strikes the workpiece.

Figure 5:
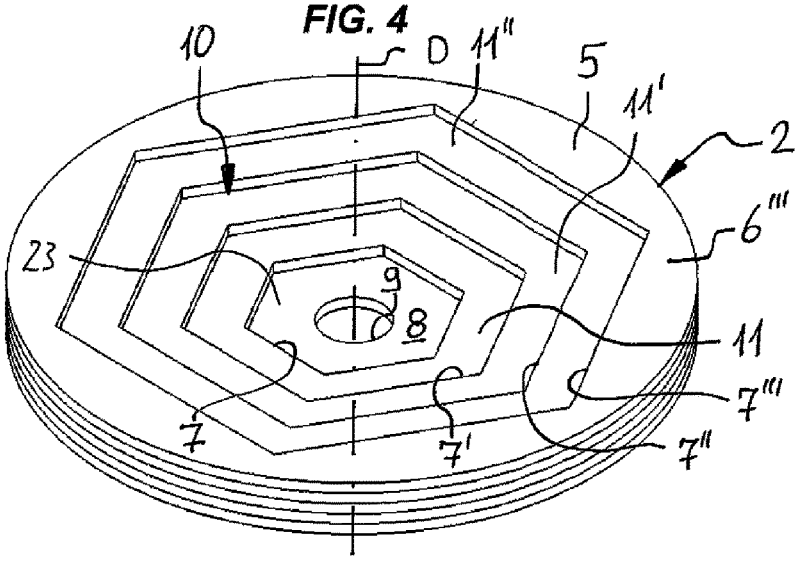
FIG. 5 illustrates a perspective view of a second embodiment of a grinding blanks packet.

FIG. 5 shows a second embodiment of a circular grinding blanks packet 2 of a grinding disc 3. The through openings 7 of the circular grinding blanks 6 are, in this embodiment, not circular in cross-section, but deviate from a circular shape. They are formed in the shape of a hexagonal polygon. The backing plate (not shown here) is formed correspondingly so that an increased rotational security of the circular grinding blanks packet 2 is ensured relative to the backing plate.

Figure 6:
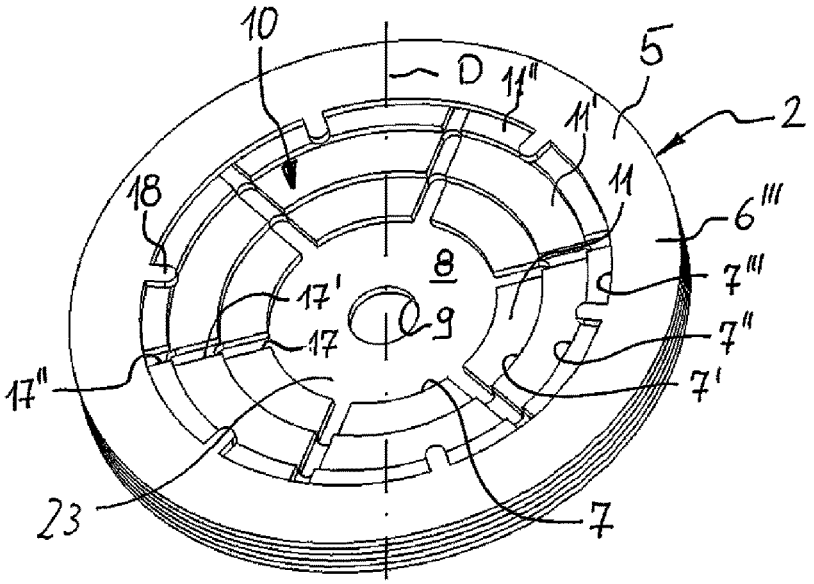
FIG. 6 illustrates a perspective view of a third embodiment of a grinding blanks packet.

FIG. 6 shows a third embodiment of a circular grinding blanks packet 2, wherein for increasing the rotational safety of the circular grinding blanks packet 2 relative to the backing plate 1 (not shown here) recesses 17 extending radially in the individual circular grinding blanks 6 are provided, wherein the circular grinding blank 6, arranged next to the rear side 5, has instead of the recesses 17 radially extending webs 18.

Figure 7:
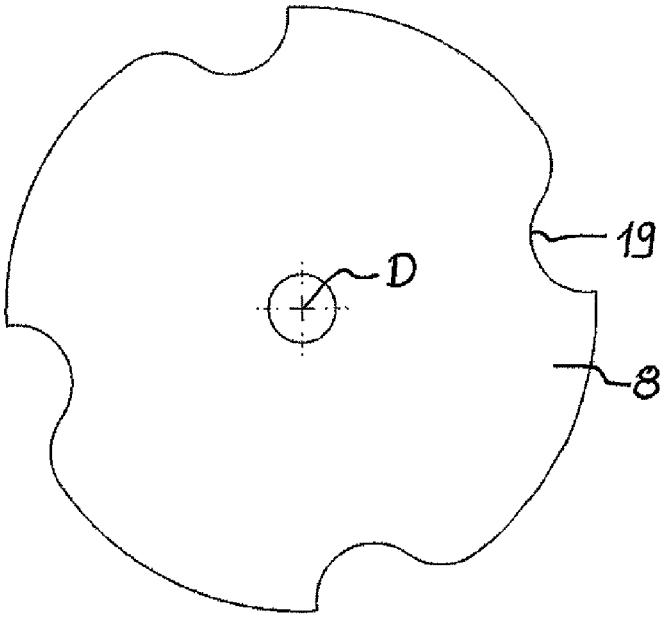
FIG. 7 illustrates a top view onto the front side of a second embodiment of a grinding disc according to one or more embodiments shown and described herein.

FIG. 7 shows a top view onto a front side 4 of a second embodiment of a grinding disc 3, wherein the outer circumferential faces 13 of the circular grinding blanks 6 have a contour deviating from a circle. In the outer circumferential faces 13 of the circular grinding blanks 6, viewing recesses 19 extending radially inwards, are provided, which enable with the rotationally driven grinding disc 3 a view onto the grinding result.

Figure 8:
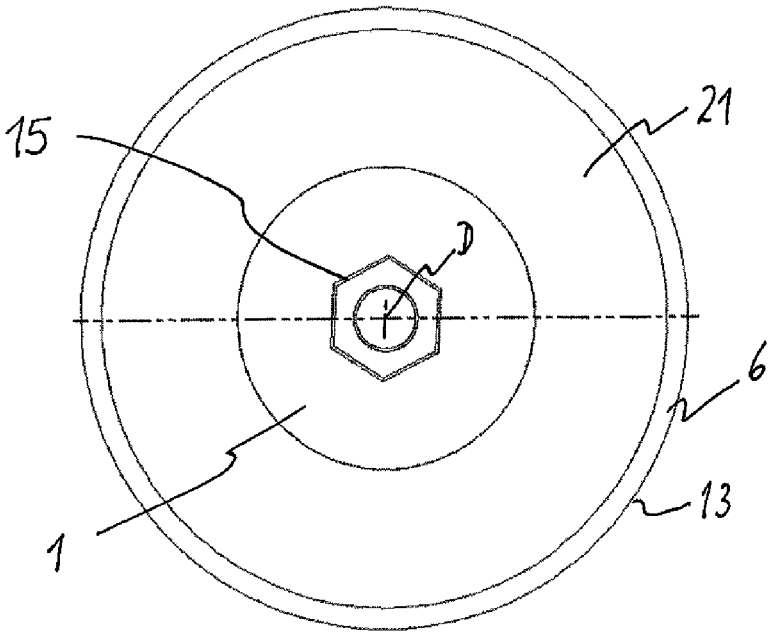
FIG. 8 illustrates a top view onto the rear side of a third embodiment of a grinding disc according to the one or more embodiments shown and described herein.
Figure 9:
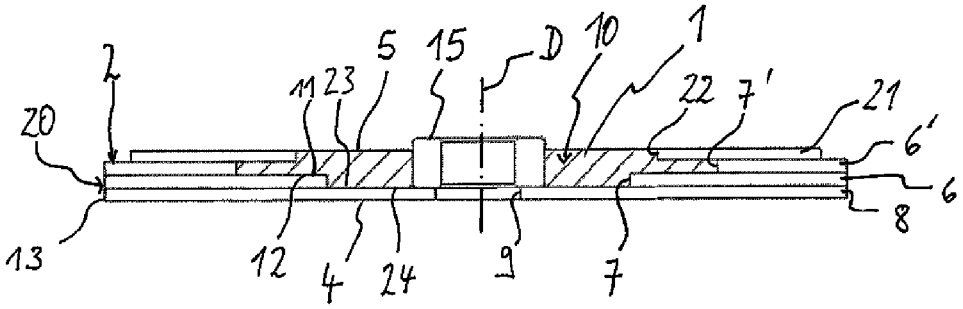
FIG. 9 illustrates a cross-sectional view of the grinding disc of FIG. 8.

FIGS. 8 and 9 show a third embodiment of a grinding disc 3, wherein the outer circumferential faces 13 of the circular grinding blanks 6 and of the final circular blank 8, as described in relation to FIGS. 1 to 6, form a circular cylindrical outer circumferential face 20. Additionally to the circular grinding blanks 6 and the final circular blank 8, the grinding disc 3 has a support layer 21 made from a glass fiber fabric with phenolic resin. The support layer 21 has also a through opening 22, which together with the further through openings 7, 9 of the circular grinding blanks 6 and of the final blank 8 form the central recess 10. The backing plate 1 is poured into the recess 10 so that also the disc-like support layer 21 is fixed to the backing plate 1. The through openings 7 of the circular grinding blanks 6 are getting larger starting from the front side 4 to the rear side 5, wherein the through opening 22 of the support layer 21 is smaller than the through opening 7 of the neighboring circular grinding blank 6. Furthermore, the support layer 21 has a smaller outer diameter than the circular grinding blanks 6.

While using the grinding disc 3 and the progressing wear of the circular grinding blanks 6 resulting, in certain circumstances, the lowest or even the lower layers of the circular grinding blanks 6 can slowly bend or fold over. This can be prevented by reinforcement in form of the support layer 21 for the axial support of the circular grinding blanks packet 2.

In a special embodiment, the recess 10 of the grinding blanks packet 2 is not only filled with hardenable material but also the last layer of the circular grinding blanks 6 is coated on the rear side with hardenable material. Thus, the last circular grinding blank 6 is fixed on the rear side additionally to the backing plate 1 and is at the same time reinforced against folding over. Alternatively, the last circular grinding blank 6 can also be substituted by a fiber disc or a disc made from a different harder material, which is more rigid than the circular grinding blank 6 arranged above.

Figure 10:
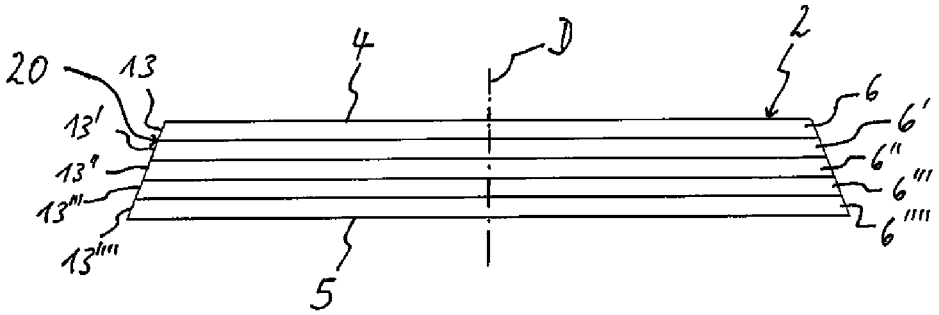
FIG. 10 illustrates a side view of a fourth embodiment of a grinding blanks packet.

In FIG. 10 a fourth embodiment of a circular grinding blanks packet 2 is shown in a side view. The individual circular grinding blanks 6 have, respectively, a circular outer circumferential face 13, wherein the outer circumferential faces 13 are formed in such a shape and size, that they form a conical outer circumferential envelope face 20 of the circular grinding blanks packet 2. The outer circumferential faces 13 of the circular grinding blanks 6 are arranged with view onto the side view by means of forming an angle $\alpha$ relative to the axis of rotation. The angle $\alpha$ can be between 5° and 85°, especially between 20° and 40° and is, here, shown only exemplary with approximately 30°. The optimal angle $\alpha$ results, however, from the grinding task, for which the grinding disc 3 should be used.

Figure 11:
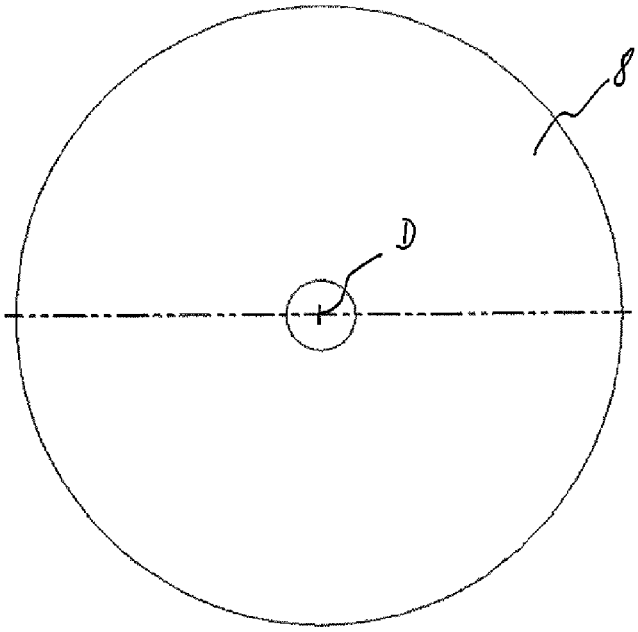
FIG. 11 illustrates a top view onto the front side of a fourth embodiment of a grinding disc according to the one or more embodiments shown and described herein.
Figure 12:
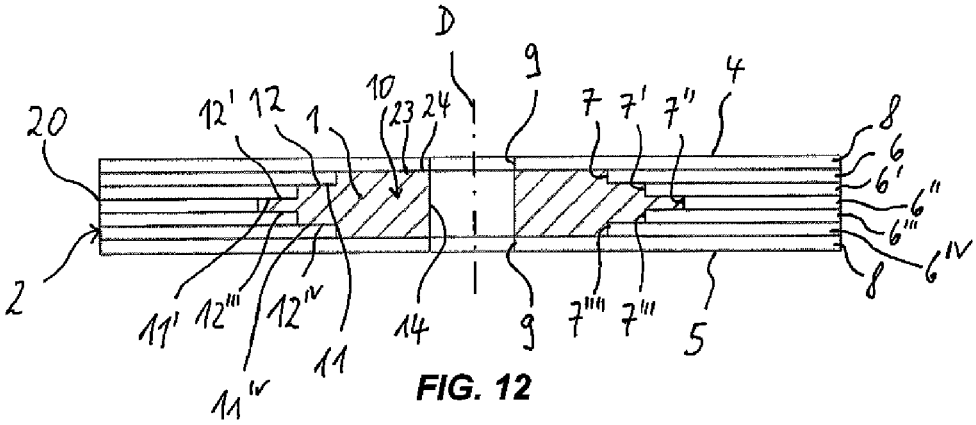
FIG. 12 illustrates a cross-sectional view of the grinding disc of FIG. 11.

FIG. 11 shows a top view onto a front side 4 of a fourth embodiment of a grinding disc 3, wherein the outer circumferential faces 13 of the individual grinding blanks 6 and of the two final circular blanks 8 have, respectively, a circular outer circumferential face 13. The outer circumferential faces 13 of all circular grinding blanks 6 and of the final circular blanks 8 have the same outer diameter so that in total a circular cylindrical outer face of the circular grinding blanks packet 2 is achieved. In FIG. 12 the grinding disc 3 according to the fourth embodiment is shown in a side view. It can be seen, that the through openings 7 of the grinding blanks 6 in contrast to the above mentioned embodiments do not, starting from the front side 4 to the rear side 5, increase continuously. Instead, the central through openings 7 of circular grinding blanks 6 and the final circular blanks 8 shown in FIG. 12 are formed at least partially differently in size. Precisely, the central through openings 7, 9 of the circular grinding blanks packet 2 are formed getting larger along a longitudinal portion extending parallel to the axis of rotation D and which extends starting from the front side 4 towards the center, wherein the through opening 7 of the center circular grinding blank 6 is the largest. Furthermore, the central through openings 7, 9 of the grinding blanks packet 2 is formed decreasing in size along a further longitudinal portion extending following and parallel to the axis of rotation D and which extends starting from the center towards the rear side 5. The through opening 9 of both of the final circular blanks 8 is formed identical and is smaller than the through openings 7 of the grinding blanks 6. Starting from the front side 5 of the in this case five grinding blanks 6 of the grinding disc 3, arranged between the final blanks 8, the first and the fifth and the second and the third circular grinding blank 6 are formed identical in shape and size.

The diameters of the through openings 7, 9 of the individual circular grinding blanks 6 and of the final circular blank 8 arranged at the front side 4 are formed stepped in a longitudinal portion, which extends starting from the front side 4 towards the center, such that annular portions 11, 23, laying open facing the rear side 5, are formed, with which these circular grinding blanks 6 and the front-sided final circular blank 8 are arranged in abutment to step-like formed attachment faces 12, 24 of the backing plate 1 and are fixed thereto. The diameters of the through openings 7, 9 of the further individual circular grinding blanks 6 and of the final circular blank 8 arranged at the rear side 5 are formed stepped in a further longitudinal portions, extending starting from the center of the circular grinding blanks packet 2 towards the rear side 5 such that annular portions 11, 23 laying open facing the front side 4, are formed, with which these circular grinding blanks 6 and the rear-sided final circular blank 8 are arranged in abutment to step-like formed attachment faces 12, 24 of the backing plate 1 and are fixed thereto. Thus, it is ensured, that an as large as possible face of the individual circular grinding blanks 6 and of the final circular blanks 8 abut the backing plate 1.

In a further embodiment, the last or the last and further layers, arranged in front of the circular grinding blanks 6, can also be inserted with the grain side against the other layers and bonded by pouring. In this case, the operator can use both sides and/or reverse the grinding disc 3. This can be of advantage, when the layers are formed varyingly, for example contain different grain sizes. However, it can also be of advantage in identical circular grinding blanks 6, as the flexibility of the circular grinding blanks 6 is generally distinctly smaller in grain direction. Thus, the two grinding coatings of neighboring abutting circular grinding blanks 6 stabilize each other and the grinding disc 3 is more rigid.

Finally, in a further special embodiment, the pouring of the backing plate 1 can also be completely omitted. In this case, a backing plate, for example a frustum-like plate from ABS-plastics or other material, which is commonly used for support plates of circular grinding blanks plates (flap grinding discs), can be used. On this, the circular grinding blanks 6 are fixed with a mastic system.

The circular grinding blanks 6 consist of grinding means on a substrate. The used substrate can be a woven fabric, scrim or flies (also pressed). The whole range of common substrates for grinding means on substrates is possible, also combinations, like for example paper-textile or other material combinations known on the market or (weak) vulcanized fibers, which wear during operation, to ensure a continuous wear of the substrate. In a preferred embodiment, the substrate and/or the finished circular grinding blanks 6 and/or the final circular blanks 8 are as far as possible strain isotropic. Thus, the substrate or the circular grinding blanks 6 or the final circular blanks 8 wear as far as possible even, i.e. circular. Tensile strengths in warp- and weft direction or also in the diagonals should be as far as possible identical. Examples are for example grinding means on substrates and substrates, like they are used in segmented broad bands. The abrasive cloth and the grinding means on substrate should generally have relative high tensile strengths. In a special embodiment grinding means on substrate with high tear resistance in as far as possible all directions (longitudinally, transversally and diagonally) are used. In a preferred embodiment, the used cloth of the grinding means on substrate is a X- or Y-substrate. In a preferred embodiment, the abrasive grain is a ceramic grain or a mixture thereof with zirconium aluminum and/or aluminum oxide abrasive.

The invention claimed is:

1. A grinding disc being rotatably drivable around an axis of rotation and having a front side and a rear side facing away from the front side, the grinding disc comprises:

a multi-layered circular grinding blank packet with a plurality of circular grinding blanks, each having an uninterrupted continuous planar surface, the circular grinding blanks being stacked over each other along the axis of rotation, each of the circular grinding blanks having a central through opening, wherein the central through openings form together a recess of the circular grinding blank packet, the recess defining a stepped inner profile in which each succeeding blank defines a different inner diameter, and wherein that the grinding disc has a backing plate arranged in the recess so that more than one of the circular grinding blanks are fixed individually to the backing plate along a flat support surface of each grinding blank which is in contact with a stepped opposing surface of said backing plate.

2. The grinding disc according to claim 1, wherein starting from the front side and extending to the rear side the central through openings of the circular grinding blanks increase in size at least along a portion of the circular grinding blank packet extending parallel to the axis of rotation.

3. The grinding disc according to claim 1, wherein starting from the rear side and extending to the front side the central through openings of the circular grinding blanks increase in size at least along a portion of the circular grinding blank packet extending parallel to the axis of rotation.

4. The grinding disc according to claim 1, wherein the grinding blanks each further include a central annular portion fixed to an attachment face of the backing plate, said attachment face being arranged parallel to the front side.

5. The grinding disc according to claim 1, wherein the backing plate is poured into the recess.

6. The grinding disc according to claim 1, wherein a threaded element having an internal thread for attaching the grinding disc to a drive machine is arranged in the backing plate.

7. The grinding disc according to claim 1, wherein the through openings of the circular grinding blanks comprise a cross-section deviating from a circle.

8. The grinding disc according to claim 1, wherein the circular grinding blanks each comprise an outer circumferential face, wherein the outer circumferential face of all circular grinding blanks are identical in shape, size and alignment.

9. The grinding disc according to claim 1, wherein the circular grinding blanks each comprise an outer circumferential face, wherein the outer circumferential faces when seen in the cross-section of the grinding disc are each arranged at an angle between 5° and 85° to the axis of rotation.

10. The grinding disc according to claim 1, wherein an outer circumferential face of each blank comprise a radial recesses.

11. The grinding disc according to claim 1, wherein the grinding disc comprises a support layer on the rear side.

12. The grinding disc according to claim 1, wherein at least a subset of the circular grinding blanks each comprise a grinding layer on a side facing towards the front side of the grinding disc.

13. The grinding disc according to claim 1, wherein at least a subset of the circular grinding blanks each comprise a grinding layer on a side facing towards the rear side of the grinding disc.

14. The grinding disc according to claim 1, wherein at least one of the circular grinding blanks comprises a plurality of segments distributed in circumferential spaced direction, said segments being separated by radially extending recesses.

15. The grinding disc according to claim 9, wherein the outer circumferential faces comprise radial recesses.

16. A grinding disc being rotatably drivable around an axis of rotation and having a front side and a rear side facing away from the front side, the grinding disc comprises:

a multi-layered circular grinding blank packet with a plurality of circular grinding blanks, each having an uninterrupted continuous planar surface, the circular grinding blanks are flatly stacked over each other along the axis of rotation, each of the circular grinding blanks having a central through opening, wherein the central through openings form together a recess of the circular grinding blank packet, wherein the central through openings of at least a subset of the circular grinding blanks of the circular grinding blank packet are formed differently-sized, and wherein the grinding disc has a backing plate arranged in the recess so that more than one of the circular grinding blanks are fixed individually to the backing plate along a flat support surface of each grinding blank which is in contact with a stepped opposing surface of said backing plate.

17. A grinding disc being rotatably drivable around an axis of rotation and having a front side and a rear side facing away from the front side, the grinding disc comprises:

a multi-layered grinding blank packet with a plurality of grinding blanks, each having an uninterrupted continuous planar surface, the grinding blanks being stacked over each other along the axis of rotation, each of the grinding blanks having a central through opening, wherein the central through openings form together a recess of the grinding blank packet, the recess defining a stepped inner profile in which each succeeding blank defines a different inner diameter, and wherein that the grinding disc has a backing plate arranged in the recess so that more than one of the grinding blanks are fixed individually to the backing plate along a flat support surface of each grinding blank which is in contact with a stepped opposing surface of said backing plate.

18. The grinding disk according to claim 17, said inner profile of each of said plurality of grinding blanks further comprising a circular profile.

19. The grinding disk according to claim 17, said inner profile of each of said plurality of grinding blanks further comprising a polygonal profile defined by an inscribed circle.

20. The grinding disk according to claim 19, said inner polygonal profile further comprising a hexagonal shape.

* * * * *